US007717355B2

(12) United States Patent
Benkovich, III

(10) Patent No.: US 7,717,355 B2
(45) Date of Patent: May 18, 2010

(54) CLOG-PROOF NOZZLE FOR SPRAY CANS

(76) Inventor: John A. Benkovich, III, 210 Cedar Rd., Chester, MD (US) 21619

( * ) Notice: Subject to any disclaimer, the term of this patent is extended or adjusted under 35 U.S.C. 154(b) by 335 days.

(21) Appl. No.: 11/952,619

(22) Filed: Dec. 7, 2007

(65) Prior Publication Data

US 2009/0145465 A1 Jun. 11, 2009

(51) Int. Cl.
*B05B 17/00* (2006.01)
*B05B 15/02* (2006.01)

(52) U.S. Cl. ..... 239/1; 239/104; 239/106; 239/288; 239/289; 239/337; 239/600; 222/148; 222/182

(58) Field of Classification Search ..... 239/1, 239/104, 106, 120, 121, 288–288.5, 289, 239/333, 337, 600; 222/148, 182, 190, 562
See application file for complete search history.

(56) References Cited

U.S. PATENT DOCUMENTS 2,737,416 A * 3/1956 Behr et al. ..... 239/121
3,729,116 A * 4/1973 Green et al. ..... 222/182
4,469,253 A * 9/1984 Beard ..... 222/182
4,470,526 A 9/1984 Cha et al.
4,823,445 A 4/1989 Diener
4,944,458 A * 7/1990 Sassenberg ..... 239/288.5
4,978,015 A 12/1990 Walker
5,062,549 A 11/1991 Smith et al.
5,094,364 A * 3/1992 Knickerbocker ..... 222/148
5,178,354 A 1/1993 Engvall
5,601,216 A 2/1997 Visco
5,890,631 A 4/1999 Spurlock et al.
6,102,258 A 8/2000 Riley et al.
6,269,985 B1 8/2001 Brody

* cited by examiner

*Primary Examiner*—Steven J Ganey
(74) *Attorney, Agent, or Firm*—Nydegger & Associates

(57) ABSTRACT

A cap is provided for preventing clogging of a spray nozzle on a container. Structurally, the cap includes a hollow, truncated cone-shaped member with first and second ends. At its first end, the cap defines an orifice dimensioned to selectively receive the spray nozzle to create a fluid-tight seal with the container. At its second end, the cap defines a periphery. Further, the cap includes a panel that has a flat surface bounded by a perimeter that is interconnected to the periphery by an intermediate section. As a result, the cone-shaped member, intermediate section and panel form a fluid chamber. Fluid is positioned in the chamber for movement between a first location where the spray nozzle is submerged and a second location where the fluid is held at a distance from the spray nozzle for removal of the cap from the spray nozzle.

20 Claims, 1 Drawing Sheet

CLOG-PROOF NOZZLE FOR SPRAY CANS

FIELD OF THE INVENTION

The present invention pertains generally to devices for capping spray nozzles and methods of using such devices. More particularly, the present invention pertains to container caps that prevent spray nozzle residue from drying and causing clogging of the spray nozzle. The present invention is particularly, but not exclusively, useful as a clogging prevention device that submerges a spray nozzle in a fluid in an inverted orientation, and that holds the fluid at a distance from the spray nozzle in an upright orientation to allow for removal from the spray nozzle before spraying.

BACKGROUND OF THE INVENTION

For convenience, many fluid products are held in containers and dispensed from spray nozzles. Spray nozzles are of particular utility for fluid products that are sticky or otherwise not optimal for handling, such as paint and hair spray. For these products, aerosol or pump-powered spray nozzles are typically used.

While nozzles are intended to facilitate the use of certain spray-applied fluid products, they often become clogged. Specifically, residue left on the nozzle from the fluid product may dry out or congeal on the spray nozzle. This residue can clog the nozzle to prevent proper dispensing of the fluid product. For instance, the clog may block the spray nozzle completely, or it may significantly alter the spray direction. In either case, continued use of the fluid product may be rendered impossible.

In light of the above, it is an object of the present invention to provide a device and method for preventing clogging of a spray nozzle. Another object of the present invention is to provide a cap for a spray nozzle container that submerges the nozzle in a fluid to prevent the nozzle from becoming clogged. Still another object of the present invention is to provide a cap to submerge a spray nozzle in fluid in a first orientation, while distancing the spray nozzle from the fluid in a second orientation. Yet another object of the present invention is to provide a fluid chamber that is selectively connected to the container for submerging a spray nozzle. It is another object of the present invention to provide a spray nozzle clogging prevention device and method that is easy to implement, cost effective and simple to use.

SUMMARY OF THE INVENTION

In accordance with the present invention, a cap is provided for preventing clogging of a spray nozzle on a container. Specifically, the cap allows the spray nozzle to be stored while submerged in fluid. As a result, air cannot dry out any residue on the nozzle, such as that remaining after spraying an aerosol from the nozzle.

Structurally, the cap includes a hollow, truncated cone-shaped member. At its narrow end, the cone-shaped member defines an orifice, while at its wide end, the cone-shaped member defines a periphery. For purposes of the present invention, the orifice is dimensioned to selectively receive the spray nozzle. As a result, the cone-shaped member, which is preferably a flexible polymeric material, is able to engage and create a fluid-tight seal with the container (i.e. the seal is fluid resistant). Specifically, the orifice of the cone-shaped member is defined by a perimeter "$P_o$" and the container includes a structure defined by a perimeter "$P_c$". Because "$P_o$" is approximately equal to "$P_c$", a frictional (i.e. interference) fit between the orifice of the cone-shaped member and the container provides for the establishment of a fluid-tight (i.e. fluid-resistant) seal between the cap and the container.

For the present invention, the cap includes a panel that has a flat surface bounded by a perimeter. Further, the perimeter is interconnected to the periphery of the cone-shaped member by an intermediate section to create a fluid chamber. In order to allow access to the chamber by the spray nozzle, the orifice is located between the panel and the periphery of the cone-shaped member.

Preferably, the fluid positioned in the chamber is water or a liquid solvent. When the container and cap are in an upright orientation, the fluid is held in the chamber between the cone-shaped member and the intermediate section to distance the spray nozzle from the fluid. As a result, when upright, the cap may be connected to or removed from the container without spilling any fluid. When the container and cap are connected and turned to an inverted orientation, the fluid is held between the panel and the intermediate section. Therefore, the spray nozzle is submerged in the fluid. In this manner, any residue on the spray nozzle cannot dry out and clog the nozzle. Further, the fluid may remove the residue from the nozzle, particularly if the fluid is a solvent.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
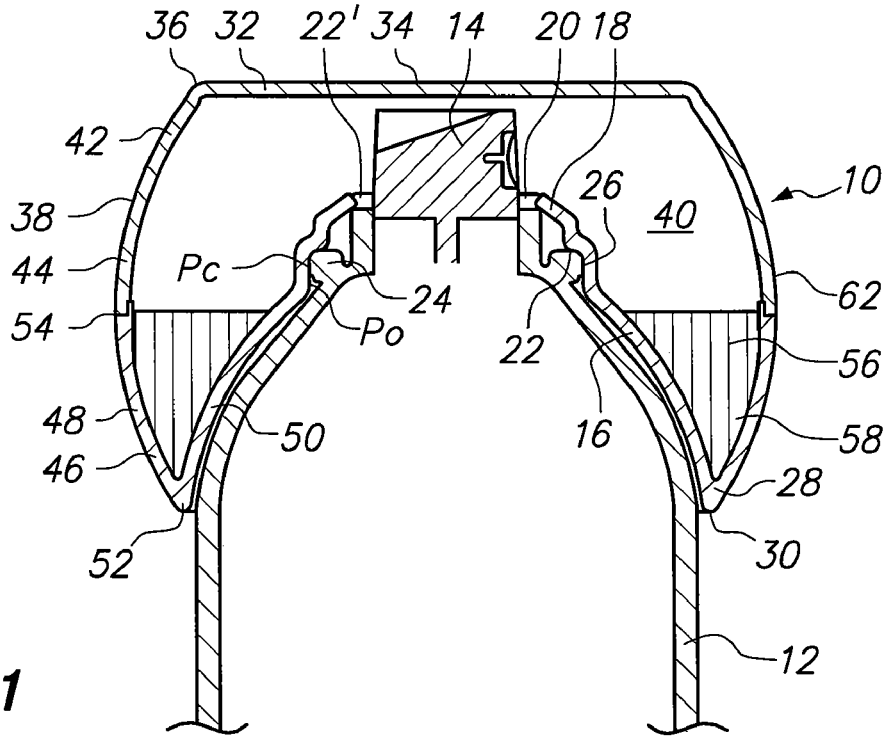
FIG. 1 is a cross sectional view of a cap connected to a spray nozzle container in an upright orientation in accordance with the present invention.

Referring initially to FIG. 1, a cap for preventing clogging of a spray nozzle is shown, and is generally designated 10. In FIG. 1, the cap 10 is fixed (secured) to a container 12 having a spray nozzle 14 like the type used with aerosols. Structurally, the cap 10 includes a hollow, truncated cone-shaped member 16. Further, the cone-shaped member 16 has an end 18 that defines an annular orifice 20 dimensioned to selectively receive the spray nozzle 14 to create a fluid-tight seal 22 with the container 12. Specifically, the orifice 20 of the cone-shaped member 16 is defined by a perimeter "$P_o$". Also, the container 12 includes a structure 24 defined by a perimeter "$P_c$". As shown, the orifice perimeter "$P_o$" is approximately equal to the container structure perimeter "$P_c$". As a result, an interference fit 26 for the fluid-tight seal 22 may be established between the orifice 20 of the cone-shaped member 16 and the container 12. Alternatively, a fluid-tight seal 22' can be established between the orifice 20 of the cone-shaped member 16 and the spray nozzle 14.

Figure 2:
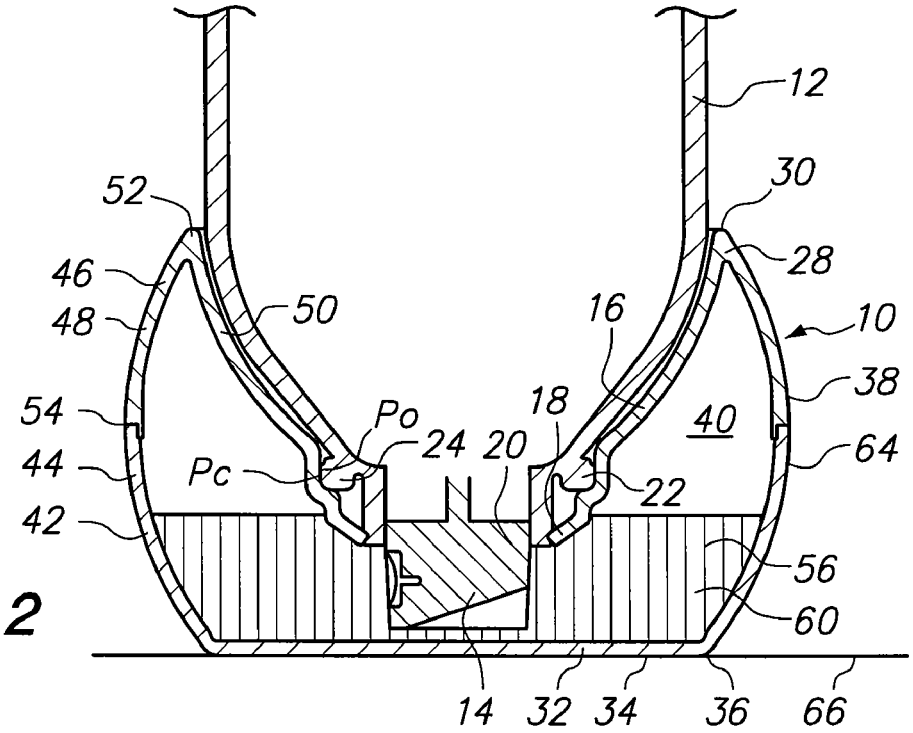
FIG. 2 is a cross sectional view of the cap and spray nozzle container of FIG. 1 in an inverted orientation in accordance with the present invention.

In FIGS. 1 and 2, it can be seen that the cone-shaped member 16 has an end 28 that defines an annular periphery 30. In addition to the cone-shaped member 16, the cap 10 includes a panel 32 formed from a flat surface 34 bounded by a circular perimeter 36. As shown, the cap 10 is provided with an intermediate section 38 that interconnects the periphery 30 of the cone-shaped member 16 with the perimeter 36 of the panel 32 to create a fluid chamber 40. As can be seen, the orifice 20 of the cone-shaped member 16 is located between the panel 32 and the periphery 30 of the cone-shape member 16.

Still referring to FIGS. 1 and 2, the structure of the cap 10 may be described in alternate terms. For example, the cap 10 may be considered to comprise a cup 42 formed with a lip 44. Further, for this perspective, the cup 42 includes a hollow, substantially annular, V-shaped lid 46. As shown, the V-shaped lid 46 has an outer edge 48 separated from an inner edge 50 by an apex 52. For purposes of the present invention, the inner edge 50 of the lid 46 defines the orifice 20 dimensioned to selectively receive and form a fluid-tight seal 22 with the container 12 or, alternatively, a fluid-tight seal 22' with the spray nozzle 14. As intended for this disclosure, reference to the fluid-tight seals 22 and 22' can be considered to be interchangeable. Structurally, the outer edge 48 of the lid 46 is joined by a bonding agent 54, or is otherwise fixed, to the lip 44 of the cup 42. As a result, the fluid chamber 40 is established between the cup 42 and the lid 46.

With the fluid chamber 40 established, a fluid 56, such as water or a liquid solvent, may be positioned in the cap 10. Specifically, the chamber 40 is partially filled with the fluid 56. As shown in FIG. 1, when the container 12 and cap 10 are upright, the fluid 56 rests at a location 58 in chamber 40 adjacent the apex 52. Conversely, as shown in FIG. 2, when the container 12 and cap 10 are inverted, the fluid 56 moves to a location 60 in chamber 40 adjacent the panel 32. In FIG. 2, it can be seen that the spray nozzle 14 is submerged in the fluid 56 in location 60 when the container 12 and cap 10 are inverted.

In operation, the fluid 56 is introduced into the chamber 40 through the orifice 20. Preferably, this is accomplished with the cap 10 oriented as shown in FIG. 2. Thus, the panel 32 will be below the orifice 20. Importantly, the volume of fluid 56 that is introduced into the chamber 40 should be just sufficient to extend from the panel 32 of cap 10, to the end 18 of the cone-shaped member 16 that defines the orifice 20. This can be tested by tilting the cap 10, and letting excess fluid 56 spill from the cap 10. The cap 10 can then be held in the upright orientation 62 shown in FIG. 1.

With the cap 10 in its upright orientation 62, it can be fixed (secured) to the container 12 and spray nozzle 14. Specifically, the spray nozzle 14 is passed through the orifice 20 until the seal 22 is established between the perimeter "$P_o$" and the perimeter "$P_c$". Preferably, the cone-shaped member 16 is formed from a flexible elastomeric material that engages the container 12 to establish the fluid-tight seal 22 (22'). As shown in the figures, a second fluid-tight seal 22' may be formed independently, or in addition to the first fluid-tight seal 22. The fluid-tight seal 22' will be created between the cap 10 and the spray nozzle 14 as disclosed above.

Thereafter, the cap 10 and container 12 are positioned in an inverted orientation 64 and may be put down with the panel 32 resting on a surface 66. When inverted, the fluid 56 surrounds the spray nozzle 14 and prevents the air from drying out any residue materials left on the spray nozzle 14 after use. Further, the fluid 56 may clean the spray nozzle 14 by removing any residue materials, particularly if the fluid 56 is a solvent.

With the above in mind, the importance of the volume limitations prescribed for fluid 56 in the chamber 40 is at least two-fold. On the one hand, the volume of fluid 56 must be sufficient to submerge the spray nozzle 14 when the container 12 is in its inverted orientation 64. On the other hand, when the container 12 is in its upright orientation 62, the fluid 56 must not overwhelm the chamber 40 and spill from the chamber 40. Aside from the volume limitations mentioned herein, the actual shape of the container 12, as well and its size and construction material, are matters of choice.

When the container 12 and spray nozzle 14 are needed, they are re-positioned in the upright orientation 62. Then, the cap 10 is removed and the container 12 and spray nozzle 14 are ready for use. If desired, the cap 10 can remain in the inverted orientation 64 (see FIG. 2) while the container 12 is being used.

While the particular Clog-Proof Nozzle for Spray Cans as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A cap for a container having a spray nozzle which comprises:

a hollow, truncated cone-shaped member having a first end defining an orifice and a second end defining a periphery, wherein the orifice is dimensioned to selectively receive the spray nozzle therethrough to create a fluid-tight seal with the container;

a panel having a flat surface bounded by a perimeter;

an intermediate section interconnecting the periphery of the cone-shaped member with the perimeter of the panel to create a fluid chamber therebetween, wherein the orifice of the cone-shaped member is located between the panel and the periphery of the cone-shaped member; and a fluid positioned in the chamber for movement therein between a first location wherein the spray nozzle is submerged in the fluid and a second location wherein the fluid is held in the chamber between the cone-shaped member and the intermediate section to distance the spray nozzle from the fluid for removal of the cap from the spray nozzle.

2. A cap as recited in claim 1 wherein the orifice of the cone-shaped member is defined by a perimeter "$P_o$" and the container includes a structure defined by a perimeter "$P_c$", wherein "$P_o$" is approximately equal to "$P_c$" to establish an interference fit for the fluid-tight seal between the orifice of the cone-shaped member and the container.

3. A cap as recited in claim 1 wherein, with the fluid in the first location, the fluid is held between the panel and the intermediate section.

4. A cap as recited in claim 1 wherein the fluid is in the second location when the container is upright, and in the first location when the container is inverted.

5. A cap as recited in claim 1 wherein the fluid is water.

6. A cap as recited in claim 1 wherein the fluid is a solvent.

7. A cap as recited in claim 1 wherein the spray nozzle is used with an aerosol.

8. A cap for a container having a spray nozzle which comprises:

a cup formed with a lip;

a hollow, substantially annular, V-shaped lid having an outer edge and an inner edge with an apex positioned therebetween, wherein the inner edge of the lid defines an orifice and the orifice is dimensioned to selectively receive the spray nozzle therethrough to create a fluid-tight seal with the container, and wherein the outer edge of the lid is bonded to the lip of the cup to establish a chamber therebetween; and a fluid positioned in the chamber for movement therein between a first location wherein fluid is in the cup and the spray nozzle is submerged in the fluid, and a second location wherein the fluid is in the lid and is distanced from the spray nozzle for removal of the cap from the container.

9. A cap as recited in claim 8 wherein the orifice is defined by a perimeter "$P_o$" and the container includes a structure defined by a perimeter "$P_c$", wherein "$P_o$" is approximately equal to "$P_c$" to establish an interference fit for the fluid-tight seal between the orifice and the container.

10. A cap as recited in claim 8 wherein the fluid is in the second location when the container is upright, and in the first location when the container is inverted.

11. A cap as recited in claim 8 wherein the fluid is water.

12. A cap as recited in claim 8 wherein the fluid is a solvent.

13. A cap as recited in claim 8 wherein the spray nozzle is used with an aerosol.

14. A method for preventing clogging of a spray nozzle on a container which comprises the steps of:

providing a cap having a hollow, truncated cone-shaped member with a first end defining an orifice and a second end defining a periphery, wherein the orifice is dimensioned to selectively receive the spray nozzle therethrough to create a fluid-tight seal with the container, a panel having a flat surface bounded by a perimeter, and an intermediate section interconnecting the periphery of the cone-shaped member with the perimeter of the panel to create a fluid chamber therebetween, wherein the orifice of the cone-shaped member is located between the panel and the periphery of the cone-shaped member;

positioning the cap in an upright orientation;

introducing a fluid in the chamber for movement therein between a first location and a second location, with said fluid in the second location when the cap is in the upright orientation, wherein the fluid is held in the chamber between the cone-shaped member and the intermediate section to distance the spray nozzle from the fluid in the second location;

securing the cap to the container by passing the spray nozzle of the container through the orifice of the cap and engaging the container with the orifice to create a fluid-tight seal therebetween; and moving the cap and container to an inverted orientation, with said fluid moving to the first location when the cap is in the inverted orientation, with said spray nozzle being submerged in the fluid in the first location.

15. A method as recited in claim 14 further comprising the step of:

returning the container and cap to the upright orientation, with said fluid moving to the second position to distance the spray nozzle from the fluid for removal of the cap from the spray nozzle; and removing the cap from the spray nozzle.

16. A method as recited in claim 14 wherein the orifice of the cone-shaped member is defined by a perimeter "$P_o$" and the container includes a structure defined by a perimeter "$P_c$", wherein "$P_o$" is approximately equal to "$P_c$" to establish an interference fit for the fluid-tight seal between the orifice of the cone-shaped member and the container.

17. A method as recited in claim 14 wherein, with the fluid in the first location, the fluid is held between the panel and the intermediate section.

18. A method as recited in claim 14 wherein the fluid is water.

19. A method as recited in claim 14 wherein the fluid is a solvent.

20. A method as recited in claim 14 wherein the spray nozzle is used with an aerosol.

* * * * *